US007568585B2

(12) United States Patent
Baughman et al.

(10) Patent No.: US 7,568,585 B2
(45) Date of Patent: Aug. 4, 2009

(54) PLASTIC, SNAP-ON CAPSEAL

(75) Inventors: Gary M. Baughman, Auburn, IN (US); Robert D. Rohr, LaOtto, IN (US)

(73) Assignee: Rieke Corporation, Auburn, IN (US)

( * ) Notice: Subject to any disclaimer, the term of this patent is extended or adjusted under 35 U.S.C. 154(b) by 596 days.

(21) Appl. No.: 10/990,876

(22) Filed: Nov. 16, 2004

(65) Prior Publication Data

US 2006/0102583 A1 May 18, 2006

(51) Int. Cl.

| | |
|---|---|
| ***B65D 41/32*** | (2006.01) |
| ***B65D 41/48*** | (2006.01) |
| ***B65D 17/40*** | (2006.01) |
| ***B65D 43/18*** | (2006.01) |
| ***B65D 51/20*** | (2006.01) |
| ***B65D 6/40*** | (2006.01) |

(52) U.S. Cl. ..... 215/254; 215/256; 215/317; 220/259.4; 220/257.2; 220/601; 220/274; 220/276; 220/780

(58) Field of Classification Search ..... 215/256, 215/254, 258, 317, 277; 220/780, 276, 257.1, 220/257.2, 259.4, 601; 222/541.6, 153.07
See application file for complete search history.

(56) References Cited

U.S. PATENT DOCUMENTS

| | | | | |
|---|---|---|---|---|
| 2,908,417 | A * | 10/1959 | Conner et al. | 220/259.4 |
| 3,927,784 | A | 12/1975 | Cochrane | 215/256 |
| 4,066,182 | A * | 1/1978 | Allen et al. | 215/256 |
| 4,230,229 | A | 10/1980 | Crisci | 215/253 |
| 4,506,797 | A * | 3/1985 | Bullock, III | 215/256 |
| 4,597,500 | A * | 7/1986 | Stubbs | 215/256 |
| 4,801,032 | A * | 1/1989 | Crisci | 215/256 |
| 4,919,286 | A * | 4/1990 | Agbay, Sr. | 215/235 |
| 5,075,951 | A * | 12/1991 | Schurr et al. | 29/428 |

(Continued)

FOREIGN PATENT DOCUMENTS

| | | |
|---|---|---|
| DE | 297 13 652 U1 | 9/1997 |

(Continued)

OTHER PUBLICATIONS

European Patent Office Search Report dated Jun. 20, 2008 from EP 05254107.5.

(Continued)

*Primary Examiner*—Robin Hylton
(74) *Attorney, Agent, or Firm*—Woodard, Emhardt, Moriarty, McNett & Henry LLP

(57) ABSTRACT

A unitary capseal for a closure that is installed in a container includes an annular sidewall, a generally circular top panel joined to the sidewall, a snap-on annular rim formed adjacent a lower edge of the sidewall, and an annular sealing lip formed adjacent the annular rim. The cooperating closure includes a serrated flange, a closing plug for threaded receipt by the flange, and a sealing gasket positioned therewith. The container end is formed around the flange interlocking with the flange serrations and creating an outer annular channel that receives the annular rim for a snap-on assembly of the capseal to the container end that in turn positions the capseal over and around the closure. The sealing lip extends radially outwardly from the sidewall and includes a concave surface facing the container end for sealing off the interior portions of the closure from collecting debris.

7 Claims, 8 Drawing Sheets

U.S. PATENT DOCUMENTS

| | | | | | |
|---|---|---|---|---|---|
| 5,292,019 | A | * | 3/1994 | Patterson | 215/256 |
| 5,423,441 | A | * | 6/1995 | Conti | 215/225 |
| 5,460,287 | A | * | 10/1995 | Cargile et al. | 220/276 |
| 5,810,190 | A | * | 9/1998 | Welch | 220/257.1 |
| 6,136,183 | A | * | 10/2000 | Suzuki et al. | 210/130 |
| 6,726,048 | B2 | | 4/2004 | Dwinell et al. | 220/257.2 |
| 2004/0045965 | A1 | | 3/2004 | Dwinell et al. | |

FOREIGN PATENT DOCUMENTS

| | | | |
|---|---|---|---|
| DE | 298 21 764 | U1 | 2/1999 |
| DE | 298 21 764 | U1 | 4/1999 |
| EP | 0 156 522 | A1 | 10/1985 |
| GB | 1 350 989 | | 4/1974 |
| WO | WO 01/38177 | A2 | 5/2001 |
| WO | WO 2005/056412 | A1 | 6/2005 |

OTHER PUBLICATIONS

European Search Report dated Jan. 28, 2008 issued in EP Patent Application No. 05254107.5.

* cited by examiner

PLASTIC, SNAP-ON CAPSEAL

BACKGROUND OF THE INVENTION

The present invention relates in general to plastic, snap-on overcaps or capseals that are constructed and arranged to assemble onto and over the assembly of a threaded closing plug as threaded into a flange that is captured by a portion of the corresponding container or drum end. A drum end is able to be fitted with a threaded opening for dispensing of the drum contents, as is well known in the art. One way to do so, and the way described herein, uses an internally-threaded flange that includes an outer peripheral edge that is shaped so as to be securely held in place by crimping drum end material over, under, and around this outer peripheral edge. Various peripheral edge configurations are contemplated for the flange, including serrations, a hex shape, or a smooth peripheral edge. The internally-threaded flange is closed by the use of a threaded plug. An annular gasket is preferably used at a selected interface location between the plug and the flange or alternatively between the plug and the drum end material that is formed over and around the flange.

When transporting product in drums of the type described herein, there may be opportunities for the product to be accessed by unauthorized persons. In order to address this possibility, tamper-evident structures are often provided that are intended to provide a visual indication of any tampering attempts. Since it is not practical to employ means that might prevent any chance of tampering, an adequate compromise is found by at least providing an indication of a possible tampering attempt. Knowing that a tampering attempt may have occurred permits the shipper or end user to check the product before dispensing that product from the container or drum.

Various tamper-evidence schemes have been conceived of over the years with varying degrees of success. Whether from a cost perspective or from an efficacy perspective, each of the prior art schemes has something within its design and/or use that can be improved up on. The present invention focuses on some of what are believed to be design deficiencies or shortcomings with some of these earlier tamper-evident approaches. For example, those prior designs that do not create a sealed interface around the closing plug expose the closing plug to the accumulation of debris in, on, and around the plug. If the selected tamper-evident approach is configured so as to seal off the assembled closing plug, this is seen as an improvement to the design of tamper-evident structures for threaded closing plugs and their corresponding flange assembly into the drum end.

When a plastic overcap or capseal is used as the tamper-evident structure of choice, the typical construction calls for removal of this cap or at least a portion of this cap prior to being able to unscrew the threaded closing plug. The method of removal and the ease of manipulation for the user are further considerations that might be improved upon. In this same context, it is seen as an improvement if some visual reminder could be provided to the user, indicating that a tampering attempt may have occurred or at least a reminder of that possibility. If a warning label or marking is left behind after any attempt at tampering, the user is given a further reminder of what might have occurred. If a portion of the capseal is left connected to the closure, then this serves to alert the shipper or end user that the remainder of the protective capseal has been removed. Attempts to remove the portion left behind can scratch the surrounding portions of the closure and/or drum end, providing a visual warning. It is therefore incumbent upon the end user, if any of these warning signs are present, to check the contents before those contents are dispensed. The present invention provides a design for a snap-on capseal that is seen as providing improvements that are novel and unobvious.

SUMMARY OF THE INVENTION

A unitary capseal for a closure that is installed in a container according to one embodiment of the present invention comprises an annular sidewall, a generally circular top panel joined to the sidewall, a snap-on annular rim, and an annular sealing lip formed adjacent to the annular rim. The closure that is installed in the container includes a flange, a closing plug, and a sealing gasket. The container end is formed around the flange, thereby creating an annular channel. The snap-on annular rim is formed adjacent a lower edge of the sidewall and is constructed and arranged to snap into the annular channel for securing the capseal to the formed container end. The annular sealing lip extends radially outwardly from the sidewall and includes a flexible surface facing the container end. In another embodiment of the present invention, the annular sealing lip includes a downwardly and outwardly extending annular rim of tapered or straight cross-section. The snap-on assembly of the capseal to the formed container end presses the annular sealing lip into sealing engagement against the container end.

One object of the present invention is to provide an improved capseal for a closure that is installed in a container.

Related objects and advantages of the present invention will be apparent from the following description.

DESCRIPTION OF THE PREFERRED EMBODIMENTS

Figure 1:
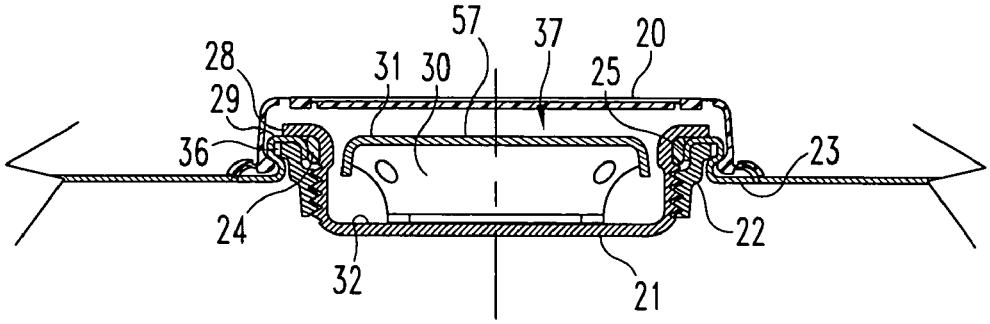
FIG. 1 is a front elevational view, in full section, of a unitary capseal as installed over a closure according to a typical embodiment of the present invention.
Figure 2:
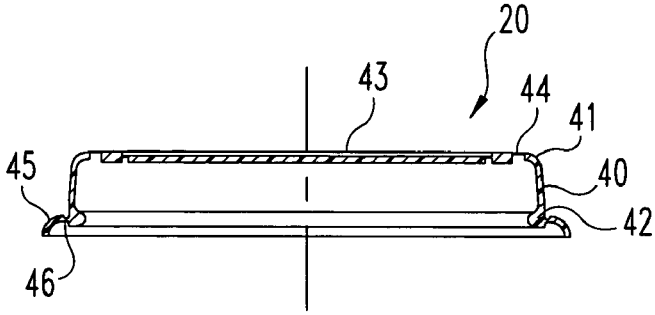
FIG. 2 is a front elevational view, in full section, of the FIG. 1 capseal.
Figure 3:
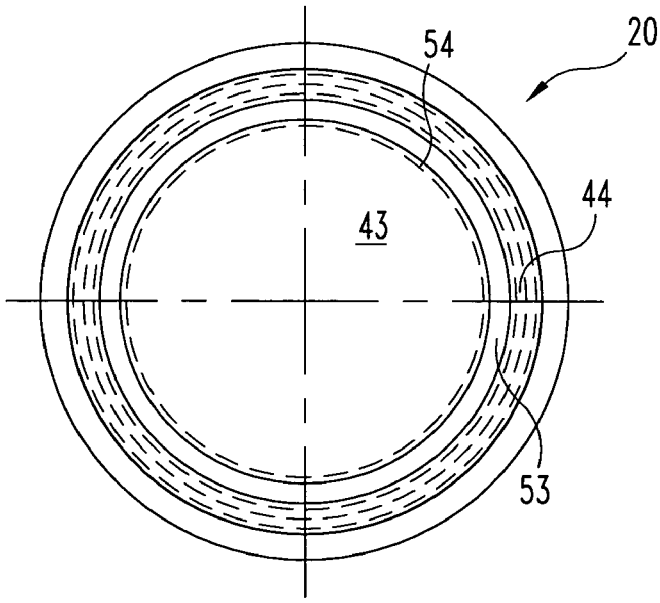
FIG. 3 is a top plan view of the FIG. 1 capseal.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIGS. 1-6, there is illustrated a unitary, molded plastic, snap-on capseal 20 that is assembled over a threaded closing plug 21 that is received by an internally-threaded flange 22 that is crimped into a drum head 23. An annular sealing gasket 24 is positioned between the plug 21 and a formed annular wall 25 of the drum head 23. Wall 25 is an annular wall portion that constitutes the innermost (radially) portion of the drum head 23. The threaded closing plug 21 includes an upper annular flange 28 that radially extends outwardly across the upper wall portion 29 of the drum head 23. When fully threaded into tight engagement with the threaded flange 22, the plug 21 captures the elastomeric sealing gasket 24. The sealing gasket 24 is stretched slightly to preassemble onto plug 21 for convenience in the threaded assembly and disassembly of the threaded plug 21. It is seen as helpful and more convenient if the sealing gasket 24 stays assembled to the plug 21 as the plug 21 is removed.

The threaded closing plug 21 includes a torque member 30 that has a raised form and a "bow tie" styled portion 31 for wrench engagement in order to threadedly advance the closing plug 21 into flange 22 and to remove plug 21 from flange 22. The torque member 30 is securely connected to the closed base panel 32 of plug 21 by the use of resistance welding projections of torque member 30. Alternative connecting hardware and methods are contemplated, but the use of resistance welding projections of torque member 30 is preferred.

The crimping of the metal of the drum head 23 into, over, and around flange 22 utilizes the peripheral serrations 36 that are formed as part of the flange. These serrations 36 are equally spaced around the periphery and are shaped with recessed spaces therebetween, also equally spaced. With the drum head pierced and drawn into a raised pocket, the flange is inserted and crimped in position to securely join together the flange 22 and the drum head 23. The crimping prevents any rotation or turning of the flange 22 relative to the drum head 23 as well as preventing any push in or pull out of the flange 22 relative to the drum head 23. A variety of perimeter shapes are contemplated including any shapes with die formed interference between matching flange and drum end panel, thereby creating a secure assembly.

As will be understood, the described fabrication and assembly of the closing plug 21, flange 22, and drum head 23 results in a number of interface seams and edges that can trap and accumulate debris. The interior space 37 of plug 21 that receives torque member 30 is also a likely location to trap and accumulate debris. One risk is that portions of such debris can break free and fall into the container when the closing plug is removed. In order to substantially reduce the amount of any such debris that might be trapped or accumulated, the snap-on capseal 20 is provided as the focus of the present invention. With added focus on FIGS. 2-4, the structural details of capseal 20 will be described, including how capseal 20 cooperates with the other components and assembles onto the formed portion of drum head 23.

Unitary, molded plastic, snap-on capseal 20 includes an annular sidewall 40 including an upper radiused bend 41 and a lower, snap-on annular rim 42. The circular top panel 43 of capseal 20 is joined to sidewall bend 41 by means of a comparatively thin, annular membrane 44 that is able to be manually severed for removing the top panel 43 from the remainder of the capseal 20. Joined to rim 42 is an annular, flexible sealing lip 45 that is constructed and arranged to press against the upper surface of drum head portion 23*a*. The flexibility of lip 45 is provided in part by the plastic construction of capseal 20 and in part by the thinner annular web 46 that connects lip 45 with rim 42 (see FIG. 4). The concave curvature of lip 45 opening in the direction of portion 23*a* utilizes the flexibility of web 46 and its resiliency to help create a sealed interface between edge 47 and portion 23*a*. While this sealed interface is not designed as a high pressure seal, it is a dynamic seal, due to web 46, or due to the lip's flexible displacement, sufficient to keep out debris and particulate matter.

Figure 4:
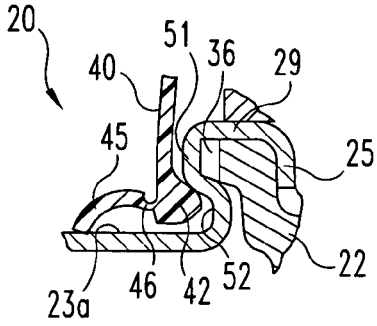
FIG. 4 is an enlarged, partial, front elevational view, in full section, of a portion of the FIG. 1 structure showing a snap-on assembly for the FIG. 1 capseal.

With continued reference to FIG. 4, the forming of the drum head 23*a* over, beneath, and around the outer perimeter of flange 22 results in creating various sections or portions including annular wall 25, upper wall portion 29, annular outer wall 51, outer annular recess 52, and portion 23*a*. In the disclosed embodiment, the outer perimeter is configured with serrations 36. Recess 52 has the form of an annular channel. The snap-on assembly of capseal 20 onto this formed part of drum head 23 utilizes the positioning of rim 42 into recess 52 for the snap-on feature as described herein. By sizing the respective diameters of rim 42 and recess 52, it is possible to guarantee that, as capseal 20 is pressed down onto the formed part of drum head 23, rim 42 flexes radially outwardly to clear outer wall 51. Actually the flexing of rim 42 causes it to slide downwardly on the outer surface of wall 51 until recess 52 is encountered. When the recess 52 is reached, the rim 42 snaps into position in recess 52, beneath wall 51. As this assembly fit is achieved, the sealing edge 47 is pushed against portion 23*a* with sufficient dimensional interference to create a dynamic seal, the flexibility of the contact being facilitated by web 46 and by the concave shape of rim 42.

The sealing lip 45 provides an added feature to the present invention in terms of a tamper-evident capability. This added feature is in addition to the fact that lip 45 creates a sealed interface against drum end portion 23*a* to keep out debris and particulate matter. The snap-on capseal 20 is constructed and arranged to press down onto the formed portion of drum end 23 and, once snapped into position, it cannot be removed without some indication of damage or tampering, as these would be apparent upon a cursory visual inspection. Trying to pry off capseal 20 likely causes a tear in capseal 20 or at a minimum stress whitening lines or areas. Any distress to the top panel 43 to try and gain access to closing plug 21 results in a tear to membrane 44 and this is apparent upon a cursory visual inspection. It is also likely that an attempt to pry off or pry up the capseal 20 will cause scratches on the adjacent surface of the drum head 23. These scratches also provide a visual indication of a tampering attempt.

Figure 5:
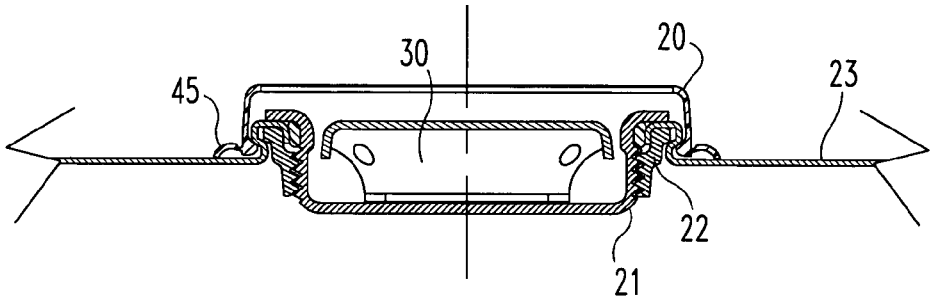
FIG. 5 is a front elevational view, in full section, of the FIG. 1 combination with a portion of the capseal removed, according to the present invention.
Figure 6:
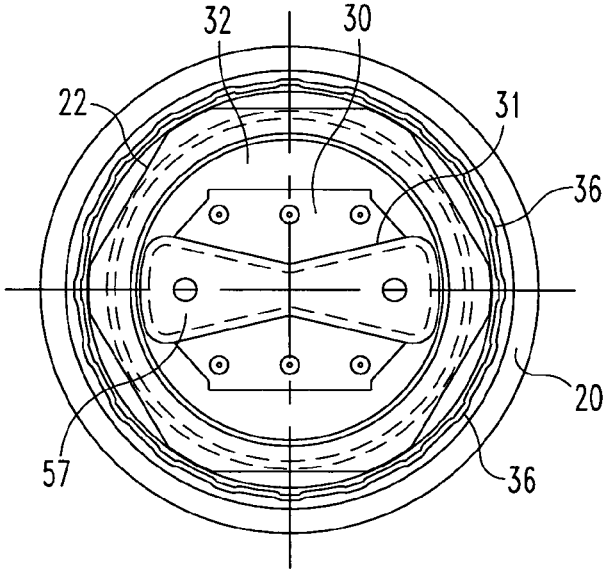
FIG. 6 is a top plan view of the FIG. 5 combination.

With the capseal 20 still intact and properly assembled, the closing plug 21 cannot be removed in order to open the container. In order to do so, the capseal 20 must first be removed or, alternatively, a portion of top panel 43 must be removed to gain access to the closing plug 21. FIGS. 5 and 6 illustrate the assembly of capseal 20 with the remainder of the closure and container end, but with the top panel 43 removed. As illustrated and described herein, the construction and arrangement of snap-on capseal 20 provides a protective covering against debris, an outer edge seal to prevent debris and particulate matter from accumulating, and a tamper-evident structure.

In terms of how sealing lip 45 assists with the tamper evident objective, it provides an outermost structure that limits access to the lower edge of rim 42. Any attempt to pry off capseal 20 must be directed at the lower edge of rim 42. If this edge is encased or enclosed by lip 45, then lip 45 must first be pried up or off in order to gain access to rim 42. Any attempt to pry off or pry up lip 45 is expected to tear through a corresponding portion of web 46, thereby providing a visual indication of a tampering attempt. Scratches may also appear on the adjacent surface portion of drum head 23.

A further feature of capseal 20 is provided by the construction of top panel 43, membrane 44, lift ring 53, and the ability to manually puncture membrane 44 with the tip of a finger, and using that puncture to initiate the removal of top panel 43 by the use of lift ring 53. Providing a thin membrane 54 around the inside diameter of lift ring 53 facilitates the use of lift ring 53 and its ability to flex upwardly in response to a downward force in the center of top panel 43. With the top panel 43 removed, it is easy to remove the remainder of capseal 20 by cutting through the sidewall or stretching the remainder of capseal 20 to disengage its snap-on assembly. However, with top panel 43 removed, there is sufficient clearance for unscrewing and removing closing plug 21 from flange 22 to have access to the contents within the container.

If customers or users of drum-style containers using this style of closure are familiar with the use of a capseal as a protective barrier against debris and as a tamper-evident feature, then the absence of a capseal will be noticed. If such a customer is intended to be the initial user of the container, as filled with the contents, and upon receipt sees that there is no capseal, then that is an immediate visual indication that a tampering attempt may have made before the container reached the intended customer. However, if the customer is not expecting a capseal, then receipt of the container without a capseal may not be seen as anything unusual and may not put the end user on notice. This end user/customer would not be aware that a tampering attempt may have occurred before the container reached its destination. For these (unfamiliar) customers, it would be helpful to have some reminder, notice, or warning that would reveal that a tampering attempt may have occurred.

The upper surface 57 of grip portion 31 provides a flat surface of sufficient size to apply a warning message. For example, upper surface 57 can be used for a message to state that the customer should inspect the contents if there is no capseal or if there is one present but it is damaged or if only a portion of a capseal has been left. Another option for a surface to apply a warning message is the upper annular flange 28.

Referring to FIGS. 7-11, there is illustrated another embodiment of the present invention in the form of snap-on capseal 60. The drum end 23, flange 22, and gasket 24 remain the same as those described in the context of FIGS. 1-6. These are the same components in all respects and their assembly is the same as that illustrated in FIGS. 1-6. The threaded closing plug 61 is substantially the same as plug 21, except for the design of bow tie portion 62 that is different from portion 31. As such, the exterior shapes, contours, dimensions, and materials presented for the snap-fit receipt of capseal 60 are virtually identical to the exterior shapes, contours, dimensions, and materials presented for the snap-fit receipt of capseal 20. The one notable difference is that capseal 60 also has a snap-fit feature for connecting capseal 60 onto portion 62 by means of projecting arms 63 and 64. Accordingly, the description for FIGS. 7-11 focuses on the construction and arrangement of capseal 60 and its assembled connection onto the formed drum end and the bow tie portion 62 of threaded closing plug 61.

With continued reference to FIGS. 7-11, capseal 60 includes an annular sidewall 67 including an upper radiused bend 68, and a lower, snap-on annular rim 69. Joined to rim 69 is an annular, flexible sealing lip 70 that is constructed and arranged to press against the upper surface of drum head portion 23*a*, similar in function to sealing lip 45, but with a different construction and arrangement. The flexibility of lip 70 is provided in part by its plastic construction and in part by its specific size and shape and the manner that it is unitarily joined to rim 69. The downwardly and outwardly extending angle (conical shape) of lip 70 causes the tip 70*a* to contact portion 23*a* before rim 69 snaps into annular recess 73. This initial contact applies pressure to portion 23*a* and thereafter the flexing of lip 70 as the snap-fit assembly of capseal 60 is completed. The pressure of lip 70 against portion 23*a* including its resiliency creates a sealed interface between lip 70 and portion 23*a*. While this sealed interface is not a high pressure seal, it is a dynamic seal that is sufficient to keep out debris and particulate matter.

Figure 8:
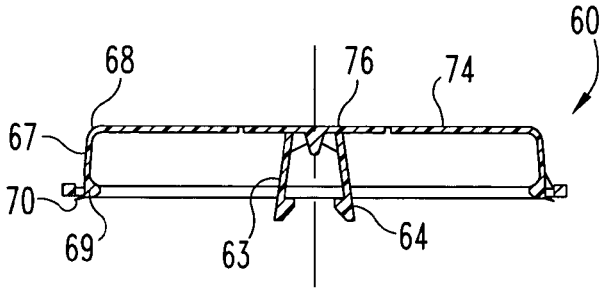
FIG. 8 is a front elevational view, in full section, of the FIG. 7 capseal.
Figure 9:
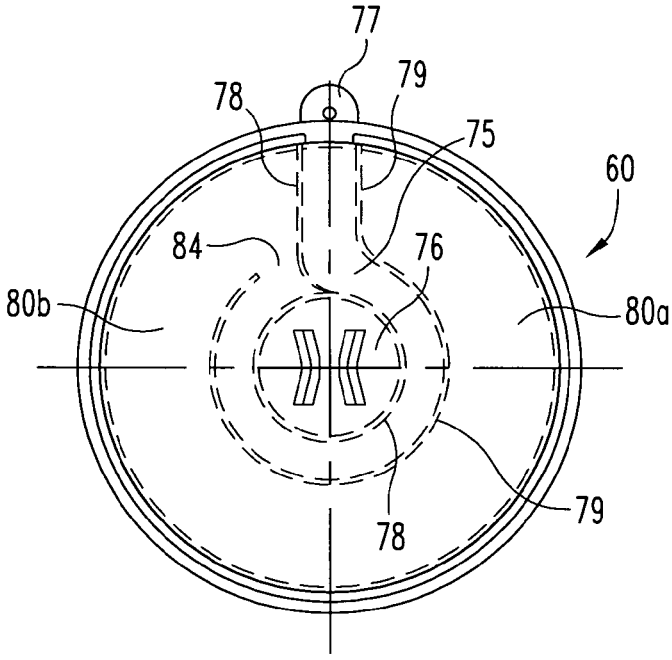
FIG. 9 is a top plan view of the FIG. 8 capseal.
Figure 10:
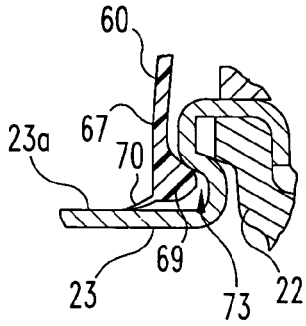
FIG. 10 is an enlarged, partial, front elevational view, in full section, of a portion of the FIG. 7 combination showing the snap-on assembly of the FIG. 7 capseal.
Figure 11:
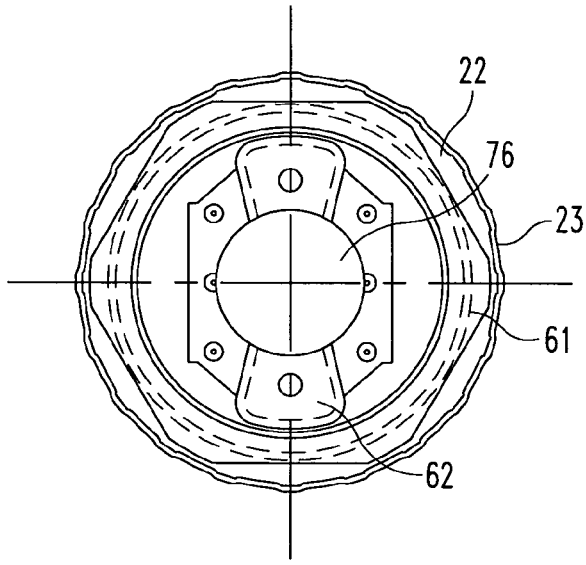
FIG. 11 is a top plan view of the FIG. 7 assembly with a majority of the capseal removed, according to the present invention.

With continued reference to FIGS. 8 and 9, it will be seen that the top panel 74 is constructed and arranged with a pull strip 75 surrounding a majority of circular disk 76. Pull strip 75 extends radially across top panel 74 and down sidewall 67 to pull tab 77. Pull strip 75 is defined by weakened score lines 78 and 79. These weakened score lines are preferably thinner membranes such that there are no breaks or perforations in the integrity of the top panel 74, continuing to contribute to its effectiveness to keep out debris and particulate matter. The pull strip 75 is constructed and arranged to facilitate the removal of capseal 60. By manually grasping pull tab 77 and pulling upwardly, the pull strip 75 separates from the sidewall 67 and then from the top panel 74. This action divides the capseal 60 into two severed portions 80*a* and 80*b* that are connected by section 84. Once the pull strip 75 is separated from the sidewall and from around disk 76, the two portion 80*a* and 80*b* can be pulled apart. This in turn allows the overcap to be freed from its snap-on assembly to the drum end and over the closure. The disk 76 is left behind due to being encircled by weakened score line 78 and by its snap-on connection by way of projecting arms 63 and 64 onto bow tie portion 62.

Figure 7:
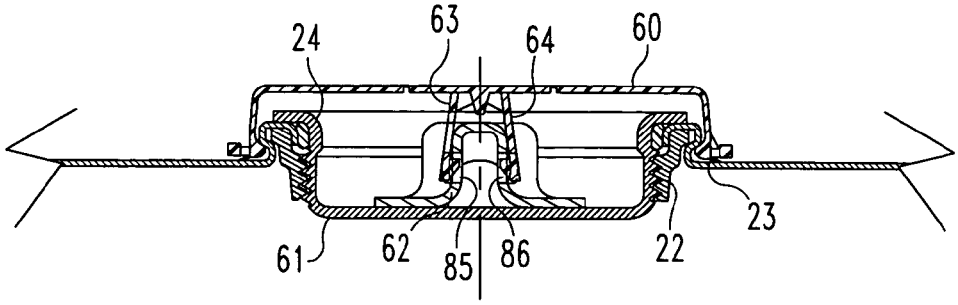
FIG. 7 is a front elevational view, in full section, of a unitary capseal as assembled over a closure that is installed in a container according to another embodiment of the present invention.

The projecting arms 63 and 64 each include a tip configuration 63*a* and 64*a*, respectively, with a ramped tooth shape and a backside abutment wall. The unitary construction with the inner surface of disk 76 allows the projecting arms to flex outwardly as portion 62 is encountered and to then snap back inwardly once openings 85 and 86 are encountered. These openings 85 and 86 receive tips 63*a* and 64*a*, respectively, as illustrated in FIG. 7.

The capture of disk 76 on portion 62 as the capseal 60 is severed and removed from the closure and drum enables the disk to carry a message regarding the removal of the capseal 60. For example, it is possible for an imprinted message on disk 76 to ask if the overcap has been removed or damaged as this would indicate the possibility of a tampering attempt. If there is a tampering attempt that removes the cap seal, it is possible that the individual responsible for the tampering would also remove the circular disk 76. However, if the tampering attempt is initiated by trying to pry up the lower edge of the capseal in an effort to try and keep the remainder of the capseal intact, having a message on the circular disk is helpful to remind the end user that he or she should double check to see whether or not there might be any damage to the capseal that could indicate a tampering attempt. Since a tampering attempt may leave scratches on the upper surface of the drum head 23, these scratches would provide another visual indication of a tampering attempt. If the end user expects to see a capseal, then the only possibility for a "successful" tampering attempt is to try and pry off the capseal or at least pry it up. While there would be a visual indication of any such attempt, it is still helpful to remind the end user to look.

Figure 12:
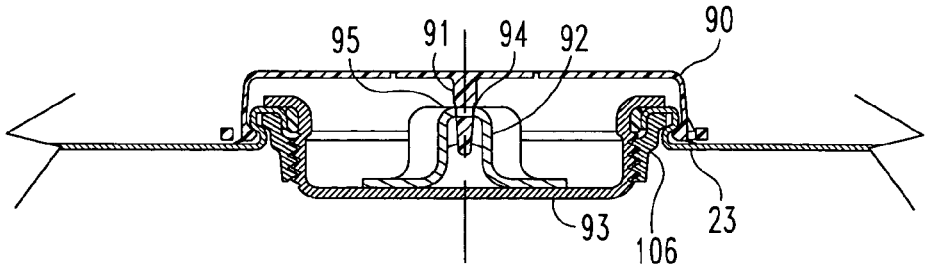
FIG. 12 is a front elevational view, in full section, of a capseal assembled over a closure that is installed in a container, according to another embodiment of the present invention.
Figure 13:
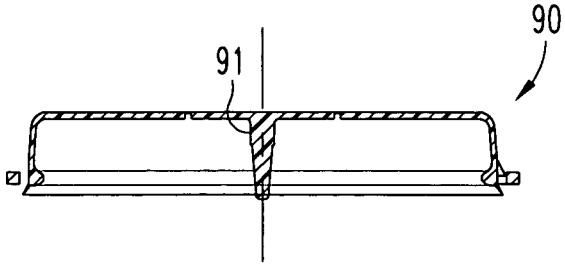
FIG. 13 is a front elevational view, in full section, of the FIG. 12 capseal.

Referring now to FIGS. 12 and 13, a design variation to the capseal 60 design of FIGS. 7-11 is illustrated. Capseal 90 is constructed and arranged to be identical to capseal 60 except that the projecting arms 63 and 64 of capseal 60 are replaced with a single axial projection 91. This design change also forces a design change to the construction and arrangement of the bow tie portion. Portion 92 of closing plug 93 includes an opening 94 in the upper surface 95. Openings 85 and 86 that were part of portion 62 have been eliminated. However, openings 85 and 86 could be retained along with opening 94 in order to provide added versatility to the style of capseal to be used. Opening 94 is sized for a press fit with projection 91. Projection 91 is tapered such that it inserts easily and then tightens as the capseal 90 is snapped onto the drum end that is formed around the closure.

Figure 14:
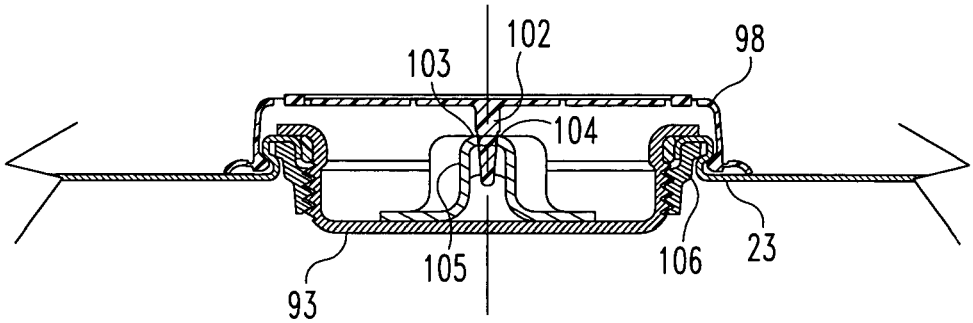
FIG. 14 is a front elevational view, in full section, of a capseal installed over a closure that is installed in a container according to another embodiment of the present invention.
Figure 15:
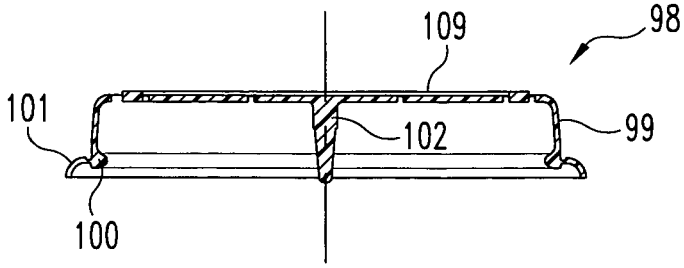
FIG. 15 is a front elevational view, in full section, of the FIG. 14 capseal.
Figure 16:
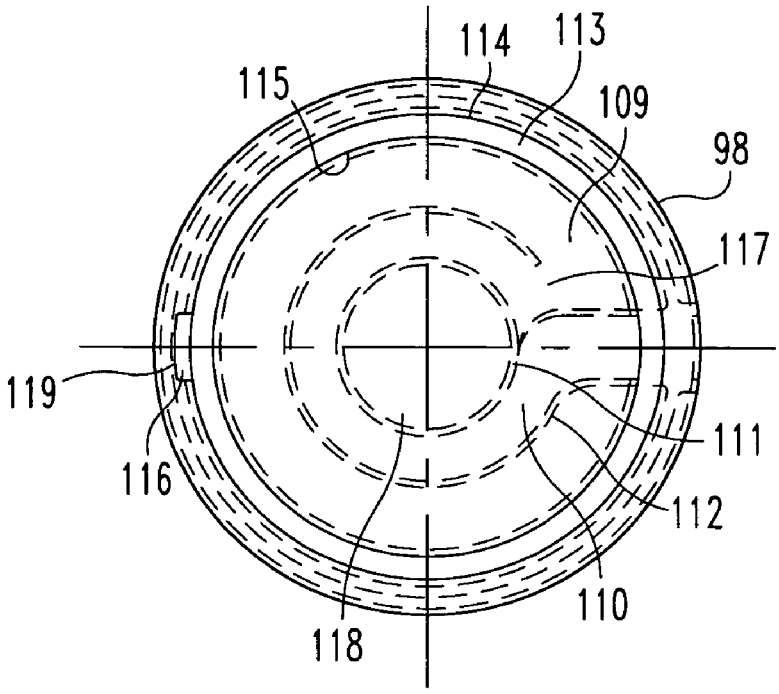
FIG. 16 is a top plan view of the FIG. 15 capseal.

Referring to FIGS. 14-16, there is illustrated another embodiment of the present invention. Capseal 98 has a construction that is similar in certain respects to capseal 20 in terms of the construction and arrangement of sidewall 99, snap-on rim 100, and sealing lip 101. These portions are substantially the same as sidewall 40, rim 42, and sealing lip 45, respectively, and function in substantially the same way. The axial projection 102 is substantially the same as projection 91 and functions in substantially the same way relative to opening 103 defined by the upper surface 104 of portion 105. Plug 93 in the FIG. 14 embodiment is the same as plug 93 in the FIG. 12 embodiment. Similarly, the flange 106 is the same in both embodiments and the same as flange 22 in the FIG. 1 embodiment as is the drum head 23 and its formed configuration over, beneath, and around the peripheral serrations of the flange.

The features that distinguish the FIG. 14 embodiment from the other embodiments disclosed herein are found primarily as part of the capseal top panel 109. As illustrated by FIG. 16, the top panel 109 includes a pull strip 110 defined by a pair of weakened score lines 111 and 112. In lieu of using the type of pull tab illustrated in FIG. 9 (tab 77), a pull ring 113 is used. Pull ring 113 is captured within top panel 109 and joined to the remainder of top panel 109 by weakened score lines 114 and 115. A pull tab 116 is used to break the pull ring free of its captured condition so that it can be used to pull the pull strip 110 free and thereby remove the capseal 98. The construction and arrangement of pull strip 110 relative to the top panel 109 is the same as the construction and arrangement of pull strip 75 relative to top panel 74. In a similar manner, a section 117, like section 84, is left. Also a circular disk 118, like circular disk 76, is left connected to the bow tie portion 105 of the plug. It is contemplated that the pull tab 116 will be held by a thin membrane 119 that can be easily broken by slipping the tip of a finger beneath the edge of the pull tab 116.

Figure 17:
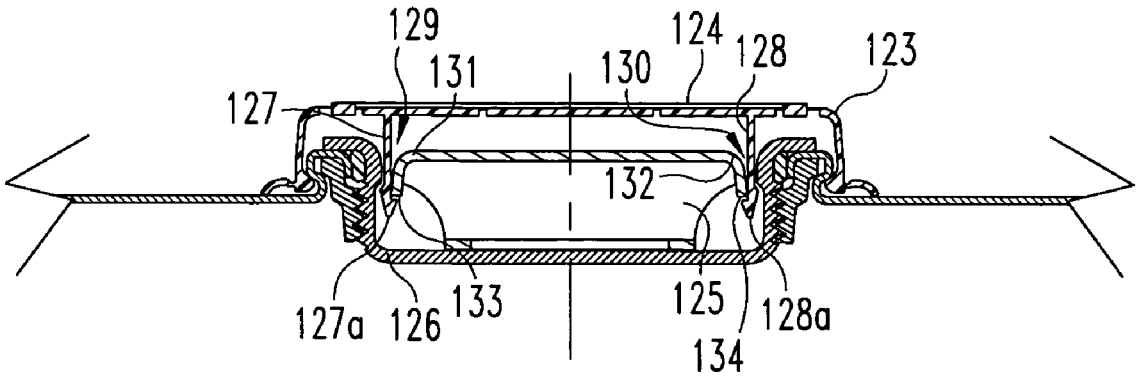
FIG. 17 is a front elevational view, in full section, of a capseal assembled over a closure that is installed in a container according to another embodiment of the present invention.

Referring now to FIG. 17, a further variation of the present invention is illustrated. The only feature that is presented by FIG. 17 that is different from the prior embodiments is the manner of anchoring or securing a portion of the capseal 123 top panel 124 to the bow tie portion 125 of the threaded closing plug 126. All other portions of the capseal 123 and closing combination of FIG. 17 are the same as the corresponding components and portions of those embodiments already described herein.

A new feature presented by FIG. 17 is the addition of two axial projections 127 and 128 each including a corresponding barbed tip 127*a* and 128*a*. By positioning these two projections over the small clearance spaces 129 and 130 between the ends 131 and 132 of the bow tie portion, each projection is able to insert into its corresponding clearance space. When the back edge of each barbed tip 127*a* and 128*a* reaches the depending edge 133 and 134 of ends 131 and 132, respectively, each barbed tip snaps against its corresponding depending edge in order to anchor the top panel 124 to portion 125.

This style of snap-lock projection can be used to additionally anchor the capseal to the plug so that any tampering attempt will be revealed by damage to the capseal 123. Another use of this style of projection is to retain some portion of the capseal top panel to the plug after the remainder of the capseal has been removed. This use is similar to retaining the circular disk, but is applicable to some other portion of the capseal or its top panel.

Figure 18:
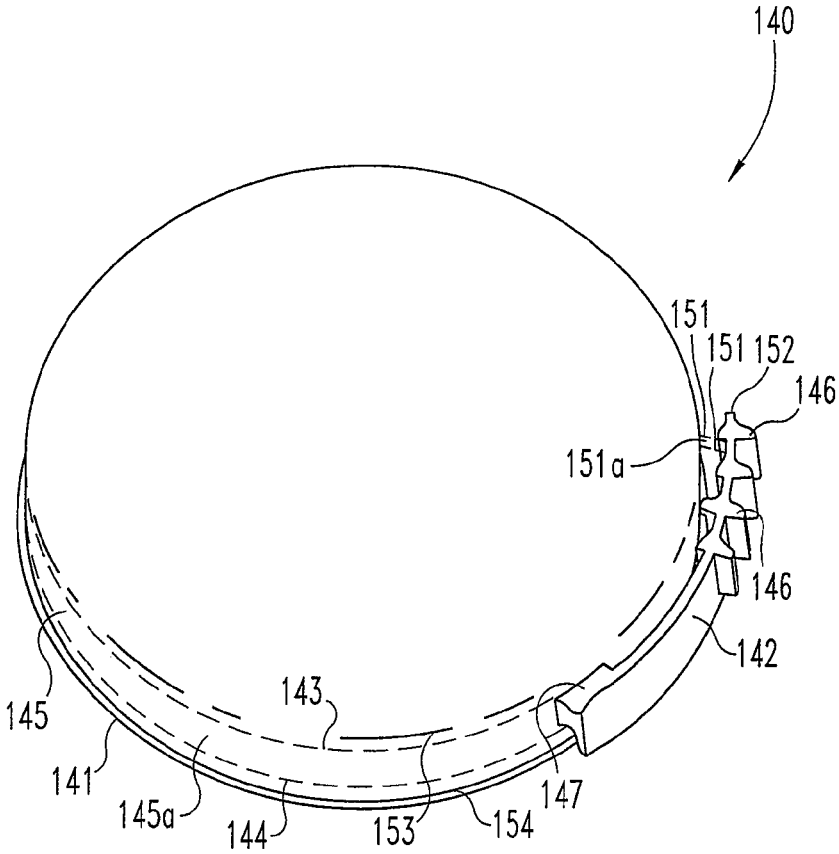
FIG. 18 is a perspective view of a unitary capseal according to another embodiment of the present invention.
Figure 19:
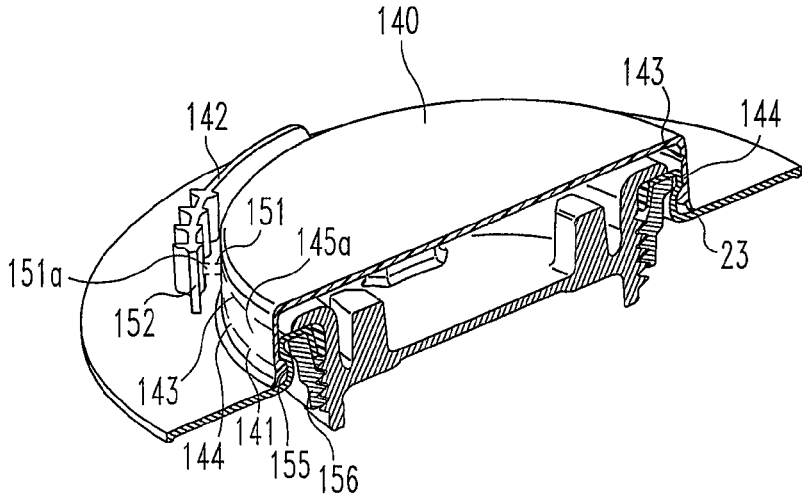
FIG. 19 is a perspective view, in full section, of the FIG. 18 unitary capseal as installed over a closure according to the present invention.

Referring now to FIGS. 18 and 19, another embodiment of the present invention is illustrated. Unitary capseal 140 is similar in size and shape to capseals 20 and 60, for example. While sealing lip 141 is constructed and arranged similar to sealing lip 70, it is contemplated that sealing lip 141 will be alternatively configured similar to sealing lip 45. The focus of the capseal 140 structure is the addition of tear tab 142 and the cooperating weakened score lines 143 and 144. Tear strip 145*a* is defined by weakened score lines 143 and 144. The reduced thickness weakening of lines 143 and 144 is from the inside surface of annular sidewall 145 so as to preserve a smooth exterior surface. Tear tab 142 is formed with easy grip lugs 146 and is joined to sidewall 145 at post 147. Post 147 is generally centered between score lines 143 and 144.

Tear tab 142 is curved so as to generally correspond to the curvature of sidewall 145. Broken lines 151 indicate an optional frangible element that can be used to hold the free end 152 of tear tab 142 close to sidewall 145. Frangible element 151*a* is integrally joined to and between tear tab 142 and sidewall 145. In use, with or without the frangible element, the free end 152 is pulled away from the sidewall 145. This action initiates the severing of score lines 143 and 144 by the connection of post 147. Score lines 143 and 144 extend around the circumference of sidewall 145 and are equally spaced apart from one another for approximately 120 degrees of the circumference of sidewall 145. At this approximately 120 degree location, the upper score line 143 ends and the lower score line 144 continues for the full 360 degrees around the circumference of sidewall 145. By continuing to pull up on tear tab 142 as the tear tab is pulled around the circumference of capseal 140, the upper portion 153 of capseal 140 is removed from the remainder of capseal 140 and is removed from the closure. The lower portion 154 of capseal 140, including sealing lip 141, remains connected to the annular channel 155 formed by the drum head 23 as part of the crimping operation to lock the flange 156 into the drum head 23. The lower score line 144 is the dividing line between the upper portion 153 and the lower portion 154.

By leaving something behind, specifically the lower portion 154, there is an immediate visual indication that there was an overcap 140 snapped onto the drum head and over the closure. The shipper or end user is thereby on notice that a tampering attempt may have occurred. If there is an attempt to remove the lower portion 154 so that there is nothing to alert or warn the shipper or end user, it is likely that scratches will be left on the upper surface of the drum head 23 adjacent the outer periphery of the lower portion 154. Due in part to the snap-on fit of the lower portion, and due in part to the presence of sealing lip 141 and the close fit of lower portion 154 relative to the drum head surface, it is very difficult to pry off, pry up, or cut free the lower portion 154 so as to separate it from the drum head without leaving marks, such as scratches. These scratches or markings on the drum head also provide a visual indication of a tampering attempt.

Figure 20:
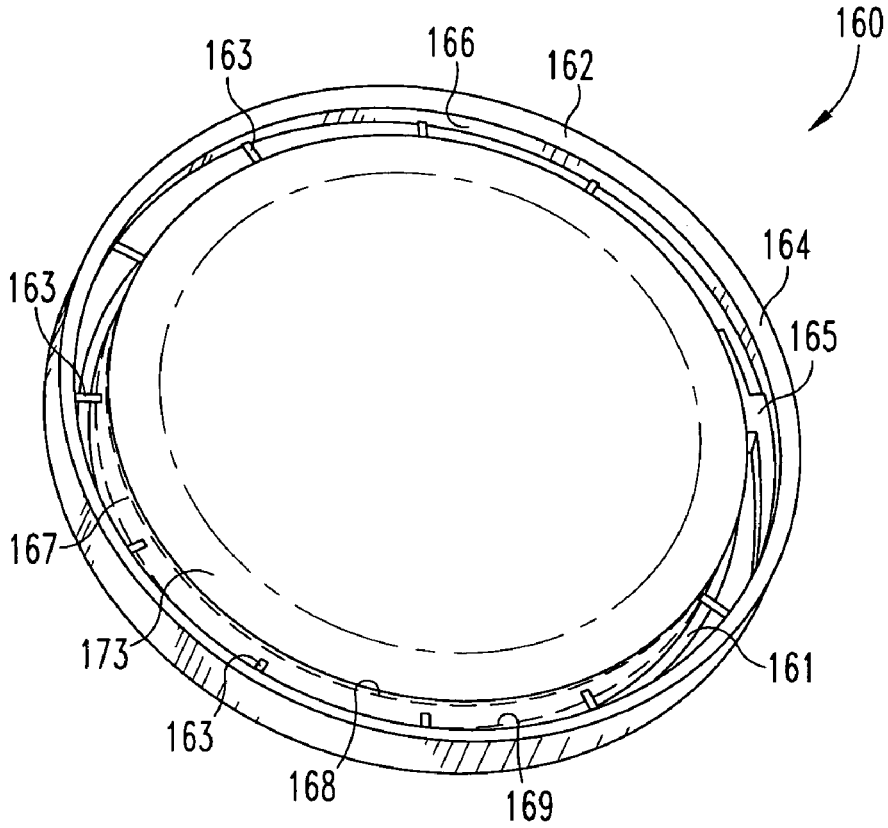
FIG. 20 is a perspective view of a unitary capseal according to another embodiment of the present invention.
Figure 21:
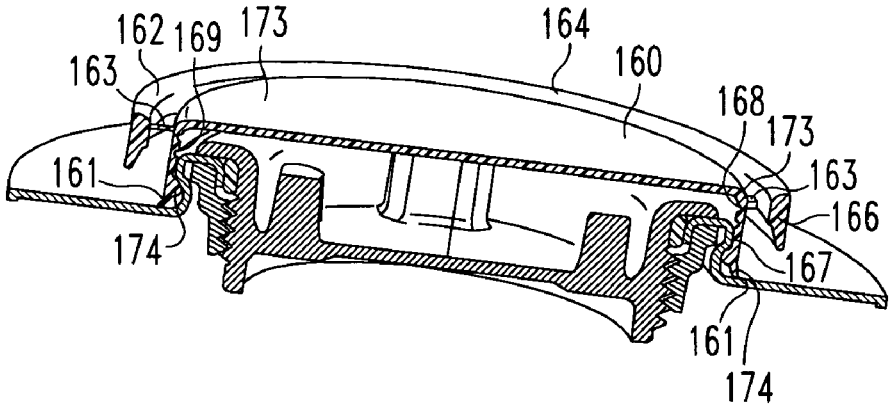
FIG. 21 is a perspective view, in full section, of the FIG. 20 unitary capseal as installed over a closure according to the present invention.

Referring now to FIGS. 20 and 21, another embodiment of the present invention is illustrated. Unitary capseal 160 is similar in size and shape to cap seals 20 and 60, for example. While sealing lip 161 is constructed and arranged similar to sealing lip 70, it is contemplated that sealing lip 161 will be alternatively configured similar to sealing lip 45. The focus of the cap seal 160 is the addition of bail handle 162 and frangible elements 163. Bail handle 162 includes pull ring 164 and connecting arm 165. There are ten (10) frangible elements 163 connecting the inner surface 166 of ring 164 with the sidewall 167. The sidewall 167 is formed on its inner surface with a pair of weakened score lines 168 and 169 that are constructed and arranged to be virtually identical in size, spacing, and circumferential extent to score lines 143 and 144 that have been described in the context of FIGS. 18 and 19. In this regard, the connecting arm 165 is positioned between the upper score line 168 and the lower score line 169. The upper score line 168 extends around the circumference of sidewall 167 for approximately 120 degrees. The lower score line 169 extends around the circumference of sidewall 167 for the full 360 degrees.

Use of the bail handle 162 begins with manually breaking the frangible elements 163 and lifting up on pull ring 164. The pull ring is pivoted toward arm 165 and with continued upward lifting, the arm 165 begins the severing of the two score lines 168 and 169. The arm 165 remains connected at one end to pull ring 164 while the opposite end remains connected to the strip of sidewall material that is pulled free as the two score lines 168 and 169 are severed.

The result of using bail handle 162 is the same as the result of using tear tab 142. The capseal 160 is separated into two portions. The upper portion 173 is removed from the closure and drum head 23 while the lower portion 174 remains snapped into channel 175. Lower portion 174 includes the sealing lip 161 and any attempt to pry up, pry off or cut through this portion of the capseal that is left behind will likely result in scratches on the adjacent surface of drum head 23. As such, the use of lower portion 174 provides a visual indication of any tampering attempt, whether the lower portion remains snapped into the formed channel or the lower portion is removed. The lower score line 169 defines the dividing line between the upper portion 173 and the lower portion 174.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A unitary capseal for a closure that is installed in a container including a container end that is formed around a portion of the closure, thereby creating an outer annular channel, said unitary capseal comprising:

an annular sidewall including a pair of spaced-apart score lines defining a tear strip;

a tear tab having a first end integrally joined with said tear strip by means of a post and a second end that is spaced apart from said annular sidewall, said tear tab further including a frangible element connecting said second end to said sidewall, wherein said post is generally centered between said score lines;

a top panel joined with said sidewall;

a snap-on annular rim formed adjacent a lower edge of said sidewall, said annular rim being constructed and arranged to snap into said annular channel for securing said capseal to said formed container end; and an annular sealing lip formed adjacent said annular rim, said sealing lip including a curved surface facing said container end, wherein the snap-on assembly of said capseal presses said annular sealing lip into sealing engagement against said container end, wherein said tear strip is spaced-apart from said annular sealing lip.

2. The unitary capseal of claim 1 which further includes an annular web of reduced thickness positioned between said annular sealing lip and said sidewall for contributing flexibility to the positioning of said annular sealing lip.

3. A unitary capseal for a closure that is installed in a container including a container end that is fanned around a portion of the closure, thereby creating an outer annular channel, said unitary capseal comprising:

an annular sidewall including first and second spaced-apart score lines defining a tear strip said first and second score lines being constructed and arranged as lines of reduced wall thickness beginning from an inside surface of said annular sidewall;

a tear tab having a first end integrally joined with said tear strip and a second end that is spaced apart from said annular sidewall;

a top panel joined with said sidewall;

a snap-on annular rim formed adjacent a lower edge of said sidewall, said annular rim being constructed and arranged to snap into said annular channel for securing said capseal to said formed container end;

said first score line being adjacent said top panel and extending circumferentially for approximately 120 degrees; and said second score line being adjacent to and axially above said snap-on annular rim and extending circumferentially for approximately 360 degrees.

4. In combination:

a container including a container end;

a closure installed into said container, said container end being formed around a portion of said closure, thereby creating an outer annular channel; and a unitary capseal for said closure, said unitary capseal comprising:

an annular sidewall including a pair of spaced-apart weakened score lines, one score line extending circumferentially a distance less than the circumferential extent of the other score line;

a snap-on annular rim formed adjacent a lower edge of said sidewall, said annular rim being constructed and arranged to snap into said annular channel for securing said capseal to said formed container end;

a tear tab unitarily joined at one end to said sidewall between said pair of spaced-apart weakened score lines and including a second end spaced apart from said sidewall and being constructed and arranged with a plurality of grip lugs;

a frangible element connecting said second end to said sidewall; and wherein manual pulling of said tear tab around the sidewall separates said tear strip and segments said capseal into a removed upper portion and a left behind lower portion, said left behind lower portion including said snap-on annular rim.

5. The combination of claim 4 which further includes an annular sealing lip formed adjacent said annular rim, said sealing lip extending radially outwardly from said sidewall and including a flexible annular sealing surface facing said container end, wherein the snap-on assembly of said capseal presses said annular sealing lip into sealing engagement against said container end.

6. The combination of claim 5 which further includes an annular web of reduced thickness positioned between said annular sealing lip and said sidewall for contributing flexibility to the positioning of said annular sealing lip.

7. The combination of claim 4 which further includes an annular sealing lip formed adjacent said annular rim, said sealing lip extending radially outwardly from said sidewall, wherein the snap-on assembly of said capseal presses said annular sealing lip into sealing engagement against said container end.

* * * * *

UNITED STATES PATENT AND TRADEMARK OFFICE

CERTIFICATE OF CORRECTION

PATENT NO. : 7,568,585 B2
APPLICATION NO. : 10/990876
DATED : August 4, 2009
INVENTOR(S) : Gary M. Baughman and Robert D. Rohr It is certified that error appears in the above-identified patent and that said Letters Patent is hereby corrected as shown below:

Column 10,
Line 37, replace "fanned" with -- formed --.

Signed and Sealed this

Thirteenth Day of October, 2009

David J. Kappos

David J. Kappos
*Director of the United States Patent and Trademark Office*